US010471620B2

(12) United States Patent
Bittner et al.

(10) Patent No.: US 10,471,620 B2
(45) Date of Patent: Nov. 12, 2019

(54) KNIFE HAVING BEAM ELEMENTS

(71) Applicant: The Procter & Gamble Company, Cincinnati, OH (US)

(72) Inventors: Dale Francis Bittner, Harrison, OH (US); Howard Jay Kalnitz, Cincinnati, OH (US); Stephen Douglas Congleton, Loveland, OH (US); Christopher Robert Lyman, Milford, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/371,596

(22) Filed: Dec. 7, 2016

(65) Prior Publication Data

US 2018/0154540 A1 Jun. 7, 2018

(51) Int. Cl.

| | |
|---|---|
| ***B26D 1/62*** | (2006.01) |
| ***B26D 7/26*** | (2006.01) |
| ***B26D 1/00*** | (2006.01) |
| ***B26D 1/40*** | (2006.01) |

(52) U.S. Cl.

CPC ..... *B26D 7/2614* (2013.01); *B26D 1/0006* (2013.01); *B26D 1/405* (2013.01); *B26D 1/62* (2013.01); *B26D 1/626* (2013.01); *B26D 2001/002* (2013.01); *B26D 2001/006* (2013.01); *B26D 2001/0053* (2013.01)

(58) Field of Classification Search

CPC ..... B26D 1/0006; B26D 7/2614; B26D 1/625–626; B26D 1/405; B26D 1/62; B26D 2001/002; B26D 2001/0053; B26D 2001/006

USPC ..... 83/331–349

See application file for complete search history.

(56) References Cited

U.S. PATENT DOCUMENTS 985,419 A * 2/1911 Kampfe ..... B26B 21/54 30/346.58
3,198,093 A 8/1965 Kirby et al.
3,638,522 A * 2/1972 Bolli ..... B26D 1/626 156/515

(Continued)

FOREIGN PATENT DOCUMENTS

EP 0555190 A3 12/1993
EP 0707928 A1 4/1996

(Continued)

OTHER PUBLICATIONS

International Search Report for International Application Serial No. PCT/US2017/064843, dated Mar. 23, 2018, 13 pages.

(Continued)

*Primary Examiner* — Kenneth E Peterson
*Assistant Examiner* — Nhat Chieu Q Do
(74) *Attorney, Agent, or Firm* — Gary J. Foose

(57) ABSTRACT

A knife including a cutting edge, a fixed edge, and a plurality of beam elements connecting the cutting edge to the fixed edge, each of the beam elements having a beam element extent oriented between about 20 degrees and about 80 degrees off of the cutting edge, each beam element separated from adjacent beam elements by a reduced stiffness zone, each reduced stiffness zone having a reduced stiffness zone extent oriented from about 20 degrees to about 80 degrees off of the cutting edge. The knife can be employed in a process and an apparatus for cutting a web.

11 Claims, 9 Drawing Sheets

(56) References Cited

U.S. PATENT DOCUMENTS

| | | | | |
|---|---|---|---|---|
| 4,444,080 | A | 4/1984 | Schulz | |
| 4,785,697 | A | 11/1988 | Gherardi | |
| 4,785,832 | A * | 11/1988 | Gherardi | A24C 5/473 131/94 |
| 4,945,798 | A | 8/1990 | Alphenaar | |
| 5,125,302 | A | 6/1992 | Biagiotti | |
| 5,241,883 | A * | 9/1993 | Coppier | B26B 9/00 30/346 |
| 5,483,729 | A * | 1/1996 | Fayard | D06C 13/00 26/15 R |
| 5,653,399 | A | 8/1997 | Koutonen | |
| 5,775,194 | A | 7/1998 | Spada | |
| 5,901,619 | A * | 5/1999 | Aihara | B21D 31/043 76/115 |
| 5,918,513 | A | 7/1999 | Ho | |
| 5,918,518 | A | 7/1999 | Kobayashi | |
| 6,058,817 | A | 5/2000 | Kobayashi | |
| 6,422,113 | B1 | 7/2002 | Blume | |
| 6,431,491 | B1 | 8/2002 | Biagiotti | |
| 6,742,427 | B2 | 6/2004 | Buta | |
| 8,440,043 | B1 | 5/2013 | Schneider | |
| 8,679,141 | B2 * | 3/2014 | Goodin | A61B 17/320016 606/159 |
| 9,364,965 | B2 | 6/2016 | Schneider | |
| 2003/0032971 | A1 * | 2/2003 | Hausmann | B23D 61/006 606/176 |
| 2005/0228343 | A1 * | 10/2005 | Kelley | A61B 17/320725 604/96.01 |
| 2006/0123959 | A1 | 6/2006 | Bocast | |
| 2008/0148913 | A1 | 6/2008 | Chen | |
| 2012/0245011 | A1 | 9/2012 | De Matteis | |
| 2014/0317940 | A1 * | 10/2014 | Scobie | B26B 9/00 30/346 |
| 2014/0345434 | A1 | 11/2014 | Scattolin | |
| 2015/0272205 | A1 * | 10/2015 | Beckmann | A24C 5/473 131/58 |
| 2015/0328781 | A1 * | 11/2015 | Chen | B26B 3/03 30/165 |
| 2016/0263760 | A1 | 9/2016 | Schneider | |
| 2018/0154533 | A1 | 6/2018 | Busch | |

FOREIGN PATENT DOCUMENTS

| | | | |
|---|---|---|---|
| EP | 2067584 | A1 | 6/2009 |
| FR | 2537037 | A1 | 12/1982 |
| KR | 20140092122 | A | 7/2014 |
| WO | WO0146053 | A1 | 6/2001 |

OTHER PUBLICATIONS

International Search Report for International Application Serial No. PCT/US2017/064846, dated Mar. 22, 2018, 13 pages.
All Office Actions for U.S. Appl. No. 15/446,378, filed Mar. 1, 2017.

* cited by examiner

KNIFE HAVING BEAM ELEMENTS

FIELD OF THE INVENTION

Cutting with a knife having beam elements.

BACKGROUND OF THE INVENTION

Manufacturing of products and packages often requires transforming a continuous flat web of material into individual products and packages. For example, soluble unit dose fabric and dish care pouches are formed from flat webs of water soluble film that are converted into three dimensional pouches by shaping and assembling layers of film. Similarly, diapers, sanitary napkins, wipes, bandages, and the like are formed by layering multiple flat webs of material upon one another and cutting the layered webs to form individual products comprised of multiple layers of material.

Webs of material can be cut in the cross direction by passing the web through the nip of a rotary press having a cutting knife mounted thereon and an anvil. As the web passes through the nip between the press and the anvil, the cutting knife strikes the web and cuts the web. To provide for a consistently complete cut of the web in the cross direction, the rotary press and anvil are set so that there is interference between the cutting knife and the anvil. That is, the rotary press and anvil are set so close to one another that cutting knife must slightly deform to permit the rotary press and the anvil to counter rotate with one another. For instance the knife may have a height of 40 mm and the peripheral surfaces of the rotary press and anvil are set such that they are only 39.9 mm apart. Thus, when the web of material is fed through the nip between the rotary press and the anvil, deformation or movement of 0.1 mm must be provided to permit the knife to pass through the nip between the surface of the rotary press and the anvil.

Ordinarily, most of the deformation is desirably provided by deformation of the knife as opposed to deformation or movement of the rotary press and or anvil. Movement of the axes of rotation of one or both of the rotary press and or anvil could result in a loss of control of movement of the web and fatigue of parts of expensive precision machine equipment. Typically anvils are formed of solid hardened material such as steel and little peripheral deformation occurs under typical cutting loads and stresses.

Since by design the knife accommodates most of the interference, the knife is loaded and unloaded each time the web is cut in the machine direction. Operators of converting lines loath having their lines shut down for maintenance. Accordingly, they try to design cutting systems on such converting lines to operate for extended periods with a minimal amount of down-time for maintenance. Ideally, operators would like to be able to make millions of cuts, and thus load and unload the knife millions of time, without shutting down the converting line. Loading and unloading of a knife mounted on a rotary press millions of time can result in fatigue of the knife, which ultimately can lead to failure of the knife. One technique for reducing fatigue in rotary cutting knives is the mount the cutting knife on the rotary press at an angle relative to the anvil so that the interference is accommodated by bending of the knife. A disadvantage of mounting a knife as such is that a variable speed rotary press operating at low speed may be needed to cut webs that are formed into three-dimensional shapes, such as for soluble unit dose fabric and dish care pouches.

With these limitations in mind, there is a continuing unaddressed need for a rotary press knife that has a long fatigue life. Surprisingly, the apparatus and process of the present invention improved the fatigue lifetime of the knife.

SUMMARY OF THE INVENTION

A knife comprising: a cutting edge; a fixed edge; and a plurality of beam elements connecting said cutting edge to said fixed edge, each of said beam elements having a beam element extent oriented between about 20 degrees and about 80 degrees off of said cutting edge, each said beam element separated from adjacent beam elements by a reduced stiffness zone, each reduced stiffness zone having a reduced stiffness zone extent oriented from about 20 degrees to about 80 degrees off of said cutting edge.

A process of cutting a web comprising the steps of: providing a web; providing a knife mounted on a press, wherein said knife comprises: a cutting edge; a fixed edge; and a plurality of beam elements connecting said cutting edge to said fixed edge, each of said beam elements having a beam element extent oriented between about 20 degrees and about 80 degrees off of said cutting edge, each said beam element separated from adjacent beam elements by a reduced stiffness zone, each reduced stiffness zone having a reduced stiffness zone extent oriented from about 20 degrees to about 80 degrees off of said cutting edge; providing an anvil supporting said web as said web passes between said anvil and said press; cutting said web with said knife as said web passes between said press and said anvil.

An apparatus for cutting a web comprising: a rotary press having a machine direction and a cross direction orthogonal to said machine direction; a rotary anvil; and a knife comprising: a cutting edge; a fixed edge; and a plurality of beam elements connecting said cutting edge to said fixed edge, each of said beam elements having a beam element extent oriented from about 20 degrees to about 80 degrees off of said cutting edge, each said beam element separated from adjacent beam elements by a reduced stiffness zone, each reduced stiffness zone having a reduced stiffness zone extent oriented from about 20 degrees to about 80 degrees off of said cutting edge; wherein said knife is mounted to said rotary press with said cutting edge oriented in said cross direction.

DETAILED DESCRIPTION OF THE INVENTION

Figure 1:
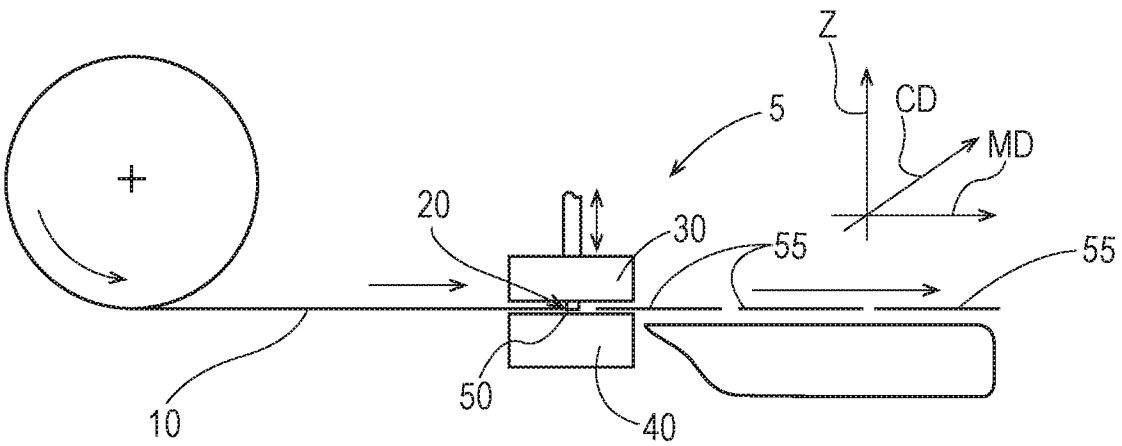
FIG. 1 is an apparatus for cutting a web.

FIG. 1 is an illustration of an apparatus 5 for cutting a web. The web 10 is conveyed to the nip 20 between the press 30 and anvil 40. A knife 50 can be mounted on the press 30. The apparatus 5 can be considered to have a machine direction MD in the direction of movement of the web 10.

As the web 10 is fed from left to right in FIG. 1, the web enters the nip 20 between the press 30 and anvil 40. The press 30 moves so that the knife 50 moves towards the anvil 40 and the knife 50 cuts the web 10 as the web 10 passes through the nip 20. This transforms the web 10 from the condition it is in upstream of the apparatus 5 into separate pieces or articles 55 downstream of the apparatus 5.

As additional length of the web 10 is fed from left to right, the knife 50 is intermittently moved towards and away from the anvil 40 to repetitively cut the web in the cross direction CD. This forms a plurality of cut articles 60. After being cut, the cut articles 55 can be conveyed away from the nip 20, by way of non-limiting example on an endless belt conveyor, positive pressure air conveyor, vacuum conveyor, or similar.

The web 10 can be flat web. For example, the web 10 can be a nonwoven, woven, film, paper, or other similar material. The web 10 can be provided as a roll of material wound in the machine direction MD.

The web 10 can be a plurality of products connected to one another in the machine direction MD. For instance the web 10 can be plurality of water soluble unit dose articles for washing clothes or dishes that are joined to one another in the machine direction MD, and optionally in the cross direction CD as well. The web 10 can be a plurality of diapers or sanitary napkins joined to one another in the machine direction MD, and optionally in the cross direction CD as well.

Each time the knife 50 is forced against the anvil 40, the contact force causes the knife 50 to be deformed in the Z direction. As the number of times that the knife 50 cuts increases, fatigue of the knife 50 becomes of increasing concern.

Figure 2:
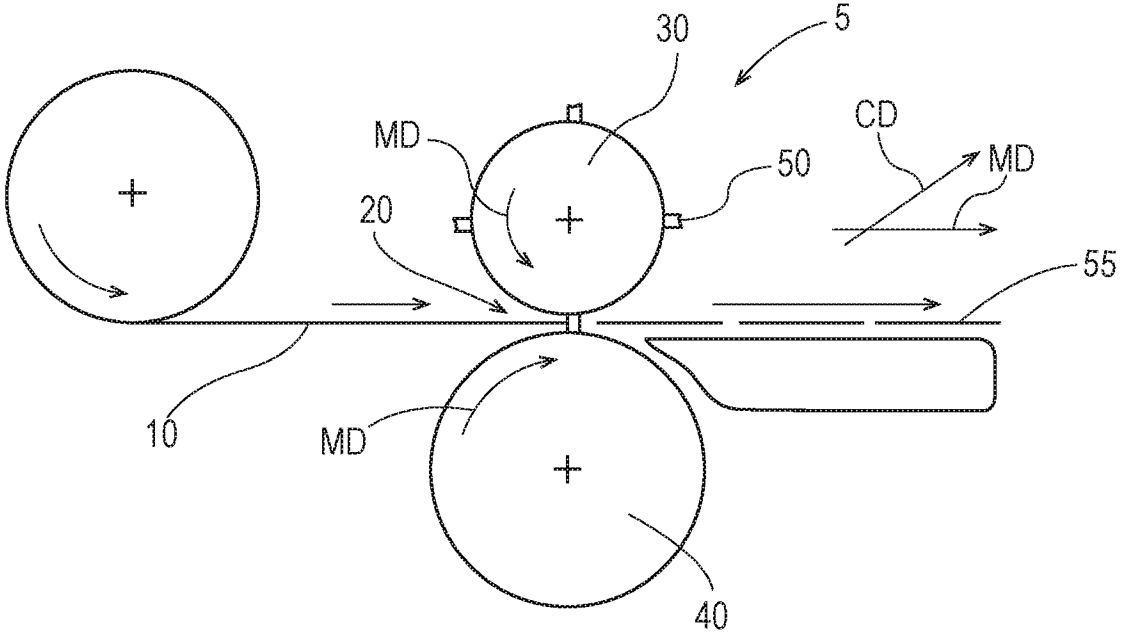
FIG. 2 is an apparatus for cutting a web, including a rotary press and rotary anvil.

A rotary apparatus 5 for cutting a web 10 is shown in FIG. 2. The web 10 is fed in the machine direction MD towards the nip 20 between a rotary press 30 and a rotary anvil 40. One or more knives 50 are mounted on the rotary press 30. As the web 10 passes through the nip 20, a knife 50 cuts the web 10. This transforms the web 10 from its condition upstream of the apparatus 5 into separate pieces or articles 55 downstream of the apparatus 5. The knife 50 or knives 50 can be mounted on the press 30, or rotary press 30, such that the knife 50 is perpendicular to, substantially perpendicular to, or about perpendicular to the surface of the press 30 or rotary press 30. Mounting the knife 50 perpendicular to, approximately perpendicular to, or within 10 degrees of perpendicular to the surface of a rotary press 30 can enable cutting shaped articles at a greater web 10 speed since a knife mounted at an angle less than about 90 degrees to the rotary press 30 may interfere with the article 55 as the article 55 passes through the nip 20. The change from mounting the knife 50 to be non-perpendicular to the rotary press 30 changes the manner in which the knife 50 accommodates deformation from being one of flexure to one in which deformation may be provided by compression and or deformation of the knife 50 in the cross direction.

In a rotary configuration, the rotary press 30 and rotary anvil 40 can be considered to have a machine direction MD as indicated in FIG. 2. The rotary press 30 and rotary anvil 40 rotate counter to one another to provide for a direction of movement though the nip 20 in the machine direction MD.

Figure 3:
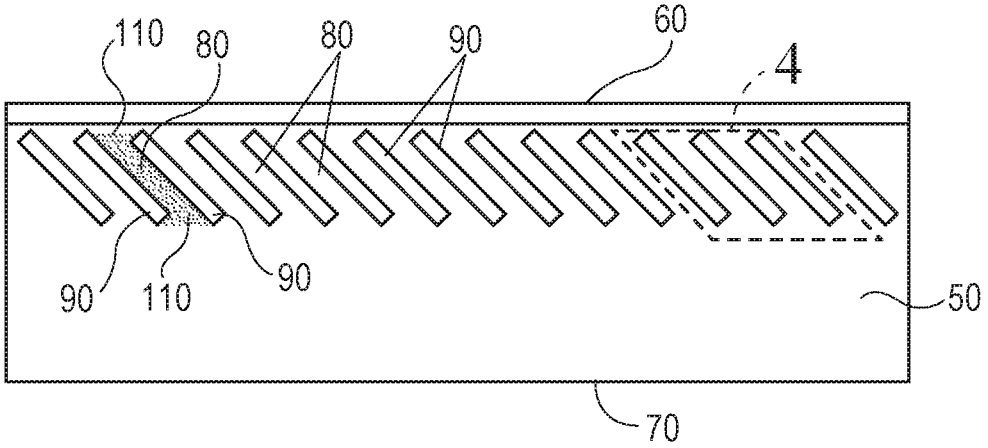
FIG. 3 is a side view of a knife.

A side view of a knife 50 is shown in FIG. 3. The knife 50 can have a cutting edge 60. The cutting edge 60 can be a sharpened portion of the knife 50. The knife 50 can be formed of a contiguous piece of thin metal or ceramic material. This material can be referred to as the knife blank. Optionally, the knife 50 can be formed by additive manufacturing in which the knife 50 is built up in multiple layers.

One edge of the knife blank can be sharpened to form the cutting edge 60. The cutting edge 60 can be shaped in any of the grinds common in the art of knife making. Such cuts can include, but not be limited to, a cut selected from the group consisting of hollow ground, flat ground, saber ground, chisel ground, compound bevel, convex ground, and combinations thereof.

The fixed edge 70 of the knife 50 can oppose the cutting edge 60 of the knife 50. The fixed edge 70 can be the edge of the knife 50 that is attached to the press 30. The knife 50 can be connected to the press 30 by through hole bolts with bolt holes provided in the knife 50. The knife 50 can connected to the press 30 by a pinch grip or wedge grip. The gripping force in such grips can be applied by a screw mechanism or spring mechanism.

The knife 50 can be thought of as comprising a cutting edge 60, a fixed edge 70, and a plurality of beam elements 80 connecting the cutting edge 60 and the fixed edge 70. The beam elements 80 act to transfer force between the fixed edge 70 and the cutting edge 60. Each beam element 80 is separated from adjacent beam elements 80 by a reduced stiffness zone 90. The beam elements 80 are defined by the material between the reduced stiffness zones 90. One of the beam elements 80 is denoted by stippling in FIG. 3.

Figure 4:
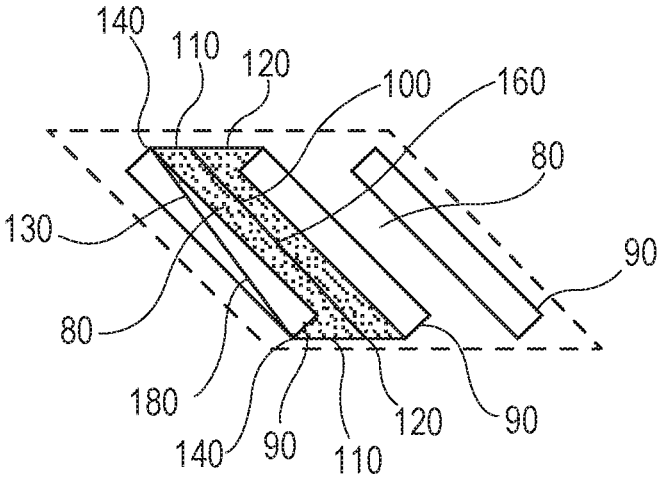
FIG. 4 is a partial view of the knife as marked in FIG. 3.

The beam elements 80 have a beam element extent 100. The beam element extent 100 is determined by connecting the reduced stiffness zones 90 adjacent a beam end 110 of the beam element 80 by a tangent line and bisecting that tangent line 120 (FIG. 4). FIG. 4 is a partial view as marked in FIG. 3. The same is done at the opposing beam end 110 of the beam element 80. The two bisection points of the tangent lines 120 define a line that is the beam element extent 100. The two tangent lines 120 define the beam ends 110.

The beam element extent 100 has a length, the length being a scalar quantity, for example 30 mm. A beam element 80 is bounded by the two reduced stiffness zones 90 between which the beam element resides and the two tangent lines 120 tangent to the reduced stiffness zones 90 at each beam end 110 of the beam element 80.

The beam element extent 100 can be oriented from about 20 degrees to about 80 degrees off of the cutting edge 60. The beam element extent 100 can be oriented from about 30 degrees to about 60 degrees of the cutting edge 60. Orienting the beam element extents 100 nearer to 45 degrees off of the cutting edge 60 can reduce the stress concentrations at the beam ends 110 proximal a reduced stiffness zone 90. The most desirable orientation of the beam element extent 100 can be a function of the shape of the beam elements 80.

The reduced stiffness zones 90 have a reduced stiffness zone extent 130. The reduced stiffness zone extent 130 is the line between the intersection of the tangent line 120 at one beam end 110 with one reduced stiffness zone end 140 and the intersection of the other tangent line 120 at the other beam end 110 with the same reduced stiffness zone end 140. The reduced stiffness zone extent 130 extends across the reduced stiffness zone 90 from one reduced stiffness zone end 140 to the other reduced stiffness zone end 140.

Each reduced stiffness zone extent 130 can be oriented from about 20 degrees to about 80 degrees off of the cutting edge 60.

The reduced stiffness zones 90 can be provided by various structures. The reduced stiffness zones 90 can be portions of the knife 50 that are thinner in the machine direction MD than the beam elements 80. That is, constituent material of the knife 50 can be removed in the reduced stiffness zones 90 so that the reduced stiffness zones 90 are thinner than the beam elements 110. Such reduced stiffness zones 90 can be provided in a knife 50 starting from a knife blank by grinding material away, laser ablating, or otherwise removing material from the knife blank to form the reduced stiffness zone 90. Similarly, the knife 50 can be built up by additive manufacturing and the reduced stiffness zones 90 can be provided by not depositing constituent material in the reduced stiffness zones 90.

The reduced stiffness zones 90 provide the knife 50 with increased flexure without exceeding the strength of the constituent material of the knife 50. The knife 50 can be provided with the desired flexure by not exceeding the yield strength of the constituent material of the knife 50, thereby providing improved fatigue resistance as compared to a conventional knife 50. Optionally, the knife 50 can be designed such that ultimate strength of the of the constituent material of the knife 50 is not exceeded.

The knife 50 can comprise a composite material. For instance, the cutting edge 60, beam elements 80, and reduced stiffness zones 90 can be comprised of different materials. The cutting edge 60 and beam elements 80 can be formed of one material and the reduced stiffness zones 90 can be formed of a second material. Such a knife can be formed by additive manufacturing. Optionally, such a knife 50 can be formed by cutting out the reduced stiffness zones 90 from a knife blank to leave voids in the knife 50, the voids, by way of non-limiting example slots, being reduced stiffness zones 90 of the knife, or by removing material from the knife blank to formed thinned portions of the knife 50 that are the reduced stiffness zones 90, as discussed previously.

Figure 5:
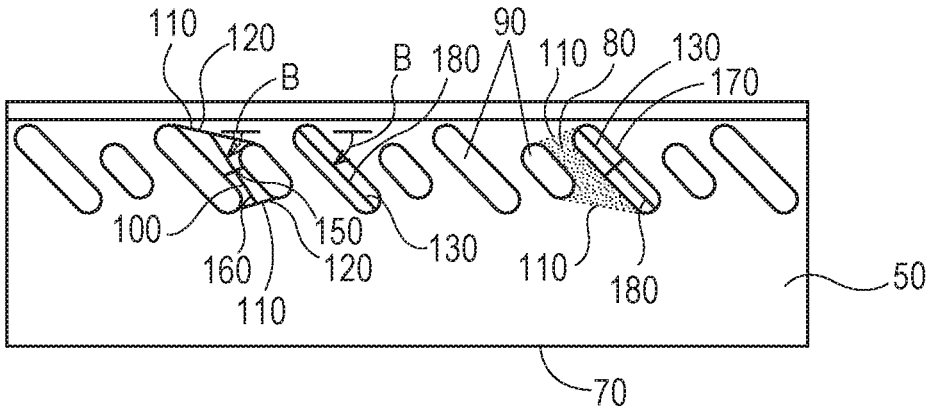
FIG. 5 is a side view of a knife.

The beam elements 80 can have shapes that differ from one another. A non-limiting example of such a knife is shown in FIG. 5. The beam element extent 100, beam ends 110, tangent lines 120, reduced stiffness zone extent 130, and reduced stiffness zone ends 140 are marked in FIG. 5. For a knife having beam elements 80 that differ in shape from one another, the reduced stiffness zones 90 can have different shapes from one another as well. Any one of, multiples of, or all of the beam elements 80, and thereby reduced stiffness zones 90, can differ in shape from one another. Each beam element 80, and thereby reduced stiffness zone 90, can have a unique shape. A knife 50 may have two different beam element 80 shapes, as shown in FIG. 5. Providing different shapes of the reduced stiffness zones 90 can be useful for customizing the stress distribution within the knife 50 and the development of cutting force of the knife 50 against the anvil 40. For instance, the thoroughness of the cutting might be made variable across the knife 50 with some portions of the knife 50 delivering a through cut of the web 10 and other portions of the knife 50 delivering a partial cut in the web 10.

As shown in FIGS. 3-5, the beam elements 80 can be oriented between about 20 degrees and about 80 degrees off of the cutting edge. In FIG. 5, the angle of the beam elements 80 off of the cutting edge 60 is marked as (3.

The reduced stiffness zones 90 do not necessarily each have the same orientation relative to the cutting edge 60. For instance one or more reduced stiffness zones 90 can be oriented at about 30 degrees off of the cutting edge 60 and one or more of the other reduced stiffness zones 90 can be oriented at about 40 degrees off of the cutting edge 60. Providing for reduced stiffness zones 90 at differing orientations can be beneficial for controlling the pathways through which stress is conducted through the knife 50, where stress concentrations occur, and the magnitude thereof. Further, the knife 50 having reduced stiffness zones 90 is more flexible in the z-direction than a similarly shaped knife 50 devoid of reduced stiffness zones 90. As the knife 50 deforms when cutting, the cutting edge 60 can move in the longitudinal direction L provide a small slicing movement to the cutting edge 60 relative to the web 10 being cut.

In conjunction with the reduced stiffness zones 90 being oriented at an angle off of the cutting edge, the beam elements 80 can be oriented as such as well. The beam elements 80 have a beam element width 150, as shown in FIG. 5. The beam element width 150 is orthogonal to the beam element extent 100 and is the maximum value of such measure orthogonal to the beam element extent 100. Likewise, the beam elements 80 have a beam element length 160, which is a scalar quantity, in line with the beam element extent 100. The beam element 80 can have a ratio of beam element length 160 to beam element width from about 2 to about 40. Like the reduced stiffness zones 90, the beam elements 80 need not have the same orientation relative to the cutting edge 60. Differing orientations of the beam elements 80 can help to control the pathways through which stresses are conducted through the knife 50, where stress concentrations occur, and the magnitude thereof. The stress in the knife 50 can be maintained at a level less than the yield strength of the constituent material of the knife 50.

The reduced stiffness zones 90 can have a reduced stiffness zone width 170, as shown in FIG. 5. The reduced stiffness zone width 170 is orthogonal to the reduced stiffness zone extent 130 and is the maximum value of such measure orthogonal to the reduced stiffness zone extent 130. The reduced stiffness zone width 170 is orthogonal to the reduced stiffness zone extent 130. Likewise, the reduced stiffness zones 90 have a reduced stiffness zone length 180, which is a scalar quantity, in line with the reduced stiffness zone extent 130. The reduced stiffness zone 90 can have a ratio of reduced stiffness zone length 180 to reduced stiffness zone width 170 from about 2 to about 40. In general, the higher the ratio of reduced stiffness zone length 180 to reduced stiffness zone width 170, other design factors being equal, the more flexible the knife 50.

The beam elements 80 can be nearer to the cutting edge 60 than to the fixed edge 70. Such an arrangement can be desirable for allowing small deformations of the cutting edge 60 to conform with the anvil 40, which might have an irregular surface, or to accommodate variability in the properties of the web 10 that have an effect on cutting.

Figure 6:
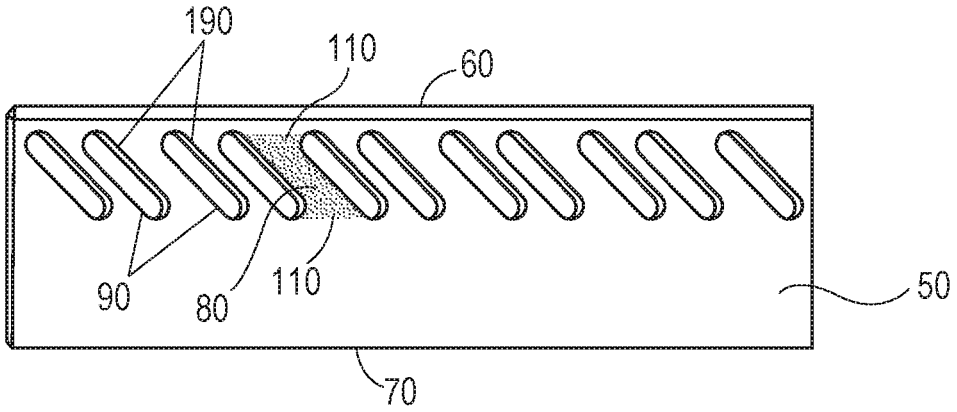
FIG. 6 is a side view of a knife having slots.

As shown in FIG. 6, the reduced stiffness zones 90 can be slots 190. Slots 190 are discontinuities in the constituent material forming the knife 50. By there being an absence of constituent material of the knife 50 at the slots 190, the slots 190 are a completely reduced stiffness zone 90. That is, since there is no constituent material of the knife 50 at the slot 190, there is no resistance to deformation of the knife 50 provided by the slot 190. Stress from the applied cutting force at the cutting edge 60 is transmitted around the slot 190 through the constituent material of the knife 50 forming the beam elements 80 towards the fixed edge where that stress is conducted to the press 30.

Slots 190 can be provided by machining out constituent material from the knife 50 to leave a void in the knife 50. Optionally, additive manufacturing can be used to build up the knife 50 and not depositing material at a position in which a slot 190 is desired.

Figure 7:
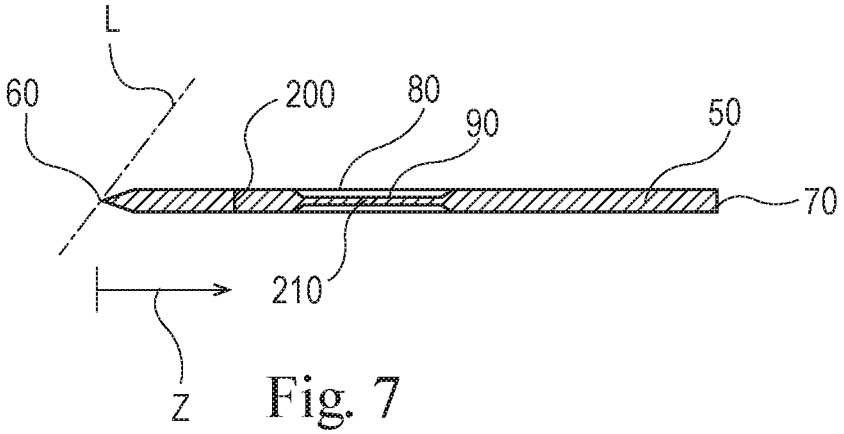
FIG. 7 is a cross section of a knife having a reduced stiffness zone that is a thinned portion of the knife.

In some instances, it may be advantageous to not provide reduced stiffness zones 90 as slots 190. Rather, it can be advantageous that the reduced stiffness zones 90 are portions of the knife 50 that are thinner than portions of the knife 50 adjacent the reduced stiffness zones 90. As shown in FIG. 7, the cutting edge 60 can define a longitudinal axis L. The knife 50 can be considered to have a z-axis between the cutting edge 60 and the and the fixed edge 70 orthogonal to the longitudinal axis L. The beam elements 80 can have a beam element thickness 200 in a direction orthogonal to a plane defined by the longitudinal axis L and the z-axis. The reduced stiffness zones 90 can have a reduced stiffness zone thickness 210, taken as the average thickness of the reduced stiffness zone 90, in a direction orthogonal to a plane defined by the longitudinal axis L and the z-axis. The beam element thickness 200 can be greater than the reduced stiffness zone thickness 210. By providing for reduced stiffness zones 90 that are thinned portions of the knife 50, deformation of the knife 50 from loads applied to the cutting edge 60 can be tuned as desirable.

Contemplated herein is a knife 50 in which the reduced stiffness zones 90 are made of a material that is different from the material that comprises the beam elements 80. The beam elements 80 can have a beam element modulus of elasticity and the reduced stiffness zones 90 can have a reduced stiffness zone modulus of elasticity. The beam element modulus of elasticity can be greater than the reduced stiffness zone modulus of elasticity. If desirable, this can be accomplished by forming slots 190 in the knife 50 and filling in the slots 190 with a material having lower modulus of elasticity than the beam elements 80, with the lower modulus of elasticity material forming the reduced stiffness zone 90, or optionally be selective additive manufacturing. The modulus of elasticity of the beam elements 80 can be from about 70 GPa to about 1200 GPa. The modulus of elasticity of the reduced stiffness zones 90 can be from about 0.001 GPa to about 1200 GPa.

The reduced stiffness zones 90 can be slots 190, portions of the knife 50 that having an average thickness less than the thickness of the adjacent beam elements 80, or portions of the knife 50 having a lower modulus of elasticity than the material comprising the adjacent beam elements 80.

The knife 50 can be practical to employ in an apparatus 5 for cutting a web 10 of material. The apparatus 5 can comprise a rotary press 30 having a machine direction MD and cross direction CD orthogonal to the machine direction, as shown in FIG. 2. The rotary press 30 can be a drum or other structure to which one or more knives 50 can be attached. The rotary press 30 can be driven by a motor. The rotary press 30 can be a single speed device, a variable speed device, intermittent speed device, or cyclically variable speed device.

The apparatus can further comprise a rotary anvil 40. The rotary anvil 40 can be a cylinder of steel, hardened steel, or other rigid material against which a web can be cut by knife 50.

The knife 50 can comprise any of the knives 50 disclosed herein. The cutting edge 60 can be a straight line or a plurality of spaced apart straight lines, by way of nonlimiting example.

As shown in FIG. 2, knife 50 can be mounted to the rotary press 30 with the cutting edge 60 can be oriented in the cross direction CD of the rotary press 30. The knife 50 can be attached to the rotary press 30 by through bolts, wedges, grips, and the like.

The knife 50 can be used in a process of cutting a web. A web 10 can be provided. The process can comprise a step of providing a knife 50 mounted on a press 30. The knife 50 can be a knife 50 as disclosed herein. The press 30 can be a rotary press 30. An anvil 40 can be provided to support the web 10 as the web 10 passes between the anvil 40 and the press 30. The anvil 40 can be rotating counter to the press 30. The web 10 can be cut with the knife 50 as the web 10 passes between the press 30 and anvil 40.

The cutting edge 60 can be a linear cutting edge 60. A linear cutting edge 60 can be employed to make straight cuts. The cutting edge can be intermittent linear sections. The shape of the cutting edge 60 can be selected so as to provide the desired contour of the cut, intermittent cut, or cut of variable depth and contour in the MD-CD plane of the web 10. An intermittent cutting edge 60 can be practical for providing perforations in a web 10. Similarly, an intermittent cutting edge 60 can be practical for providing for a frangible boundary in the web 10. The cutting edge 60 can be shaped in the z-axis to provide for a variable depth of cut in the web 10 or even a variable depth of an incision in the web 10. Intermittently spaced cuts, variable depths of incision, through cuts, and shaped cuts or incisions in combination with continuous cuts and intermittent cuts can be provided to provide the desired cut, perforation, frangible boundary, and the like. These various alterations of the web 10 can be provided by selecting the shape of the cutting edge 60 and the relationship between the cutting edge 60 and the anvil 40.

Figure 8:
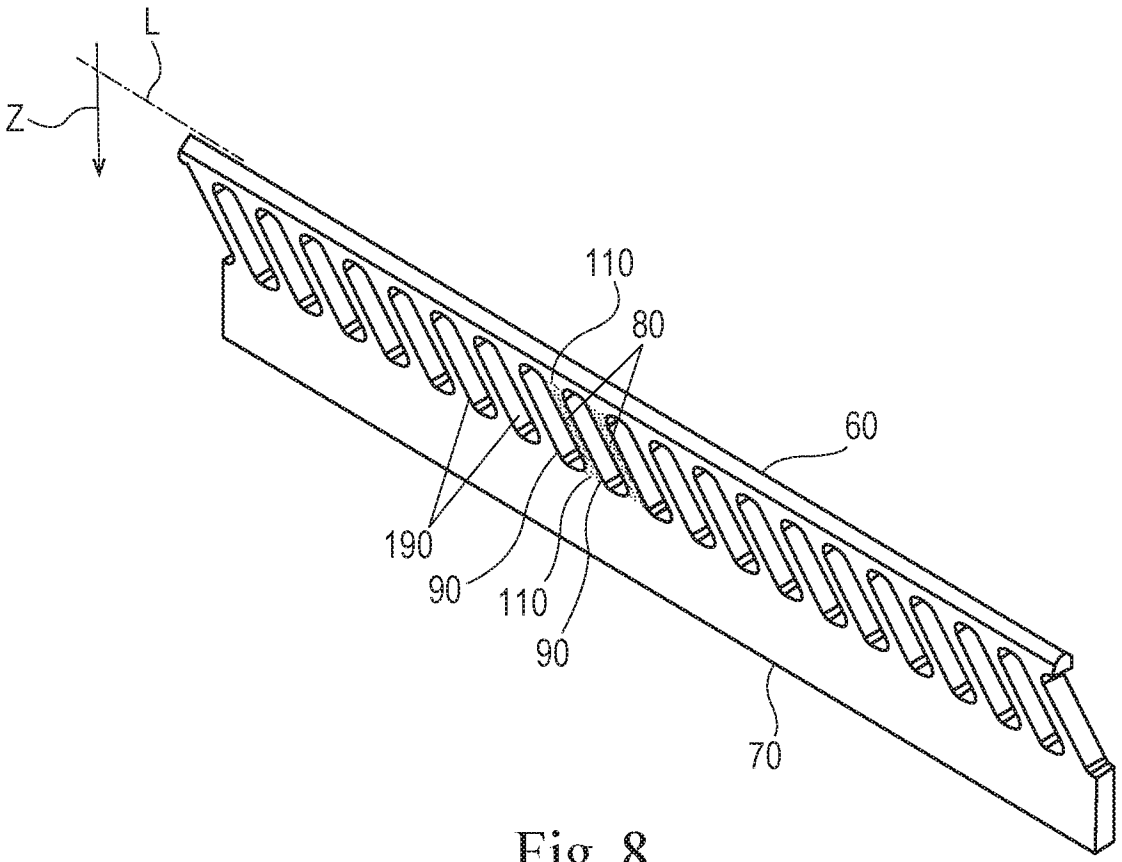
FIG. 8 is a perspective view of a knife.

An example of a knife 50 is shown in FIG. 8. The knife 50 can be comprised of steel. The knife 50 can have beam element width 150 of about 2.8 mm or even about 3.2 mm. The knife 50 can have a beam element length 160 of about 19 mm or even about 28 mm. The knife 50 can have a reduced stiffness zone width 170 of about 4.9 mm or even about 7.1 mm. The knife 50 can have a reduced stiffness zone length 180 of about 19 mm or even about 28 mm. The knife 50 can have a distance between the cutting edge 60 and fixed edge 70 of about 33.5 mm. the knife 50 can have a cutting edge 60 having a length of about 210 mm. The knife 50 can have a thickness of about 3 mm or even about 5 mm or even about 7 mm.

Figure 9:
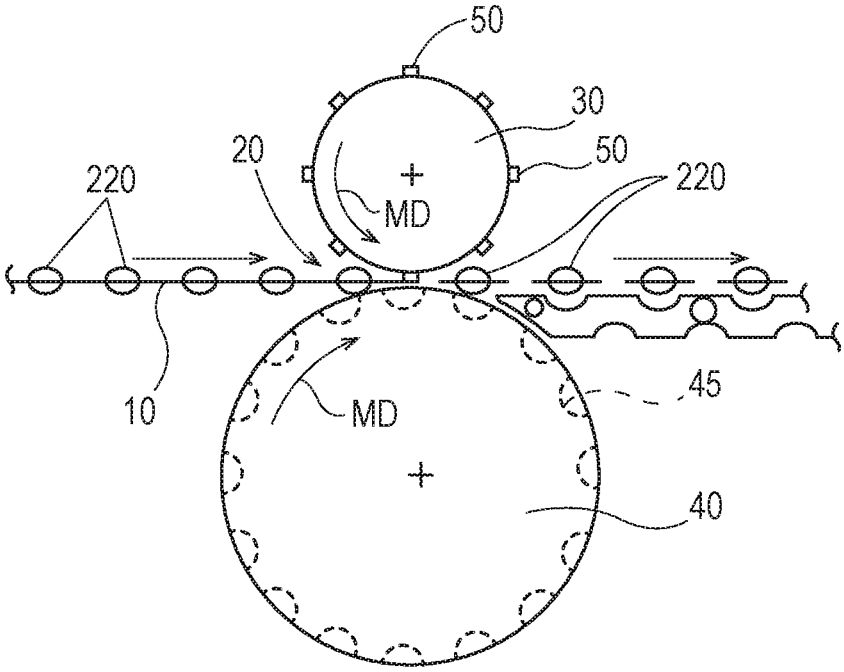
FIG. 9 is an apparatus for cutting a web of pouches.

The knife 50 can be used in a process for cutting water soluble unit dose pouches 220, by way of nonlimiting example as shown in FIG. 9. A web 10 of pouches 220 connected to one another in the machine direction MD can be fed into the nip 20 between the press 30 and anvil 40 and cut. The press 30 can be a rotary press 30 provided with a plurality of knives 50 spaced apart from one another in the machine direction MD at a spacing corresponding to the pitch between individual pouches 220 so that individual pouches 220 cut from one another. The anvil 40 can be provided with pockets 45 to accommodate the pouches 220.

The cutting edge 60 can be connected to the fixed edge 70 by a plurality of beam elements 80 arranged end to end and integral with one another, by way of nonlimiting example as shown in FIG. 10. Each of the beam elements 80 shown in FIG. 10 has a pair of opposing beam element ends 230. For two beam elements 80 arranged end to end and integral with one another, one beam element 80 can be arranged at one angle relative to the cutting edge 60 and another beam element 80 can be arranged at another angle relative to the cutting edge 60. In the illustration shown in FIG. 10, the beam elements 80 located most closely to the cutting edge 60 are oriented between about 20 degrees and about 80 degrees clockwise off of the cutting edge 60. The beam elements 80 located most closely to the fixed edge 70 are oriented between about 20 degrees and about 80 degrees counter clockwise off of the cutting edge 60. The plurality of beam elements 80 can be integral with one another in that they comprise a contiguous constituent material.

Likewise, each beam element 80 can be separated from adjacent beam elements 80 by a reduced stiffness zone 90. A plurality of reduced stiffness zones 80 can be arranged end to end and continuous with one another, by way of nonlimiting example as shown in FIG. 10. Each reduced stiffness zone 90 in FIG. 10 has a pair of opposing reduced stiffness zone ends 240. For two reduced stiffness zones 90 arranged end to end and continuous with one another, one reduced stiffness zone 90 can be arranged at one angle relative to the cutting edge 60 and another reduced stiffness zone 90 can be arranged at another angle relative to the cutting edge 60. In the FIG. 10, the reduced stiffness zones 90 located most closely to the cutting edge 60 are oriented between about 20 degrees and about 80 degrees clockwise off of the cutting edge 60. The reduced stiffness zone 90 located most closely to the knife edge 70 are oriented between about 20 degrees and about 80 degrees counterclockwise off of the cutting edge.

Combinations

A. A knife (50) comprising:
- a cutting edge (60);
- a fixed edge (70); and
- a plurality of beam elements (80) connecting said cutting edge to said fixed edge, each of said beam elements having a beam element extent (100) oriented between about 20 degrees and about 80 degrees off of said cutting edge, each said beam element separated from adjacent beam elements by a reduced stiffness zone (90), each reduced stiffness zone having a reduced stiffness zone extent (130) oriented from about 20 degrees to about 80 degrees off of said cutting edge.

B. The knife of Paragraph A, wherein said beam element extents are oriented from about 30 degrees to about 60 degrees off of said cutting edge.

C. The knife according to Paragraph A or B, wherein said beam elements are nearer to said cutting edge than to said fixed edge.

D. The knife according to any of Paragraphs A to C, wherein said reduced stiffness zones are slots (190).

E. The knife according to any of Paragraphs A to D, wherein said beam elements have a beam element width (150) orthogonal to said beam element extent and a beam element length (160) in line with said beam element extent, wherein said beam element has a ratio of beam element length to beam element width from about 2 to about 40.

F. The knife according to any of Paragraphs A to E, wherein said reduced stiffness zones have a reduced stiffness zone width (170) orthogonal to said reduced stiffness zone extent and a reduced stiffness zone length (180) in line with said reduced stiffness zone extent, wherein said reduced stiffness zone has a ratio of reduced stiffness zone length to reduced stiffness zone width from about 2 to about 40.

G. The knife according to any of Paragraphs A to F, wherein said cutting edge defines a longitudinal axis (L) and said knife has a z-axis (z) between said cutting edge and said fixed edge orthogonal to said longitudinal axis and said beam elements have a beam element thickness (200) and said reduced stiffness zones have a reduced stiffness zone thickness (210) both of which are in a direction orthogonal to a plane defined by said longitudinal axis and said z-axis, wherein said beam element thickness is greater than said reduced stiffness zone thickness.

H. The knife according to any of Paragraphs A to G, wherein said beam elements have a beam element modulus of elasticity and said reduced stiffness zones have a reduced stiffness zone modulus of elasticity, wherein said beam element modulus of elasticity is greater than said reduced stiffness zone modulus of elasticity.

I. A process of cutting a web (10) with the knife according to any of Paragraphs A to J comprising the steps of:
- providing a web (10);
- providing said knife mounted on a press (30);
- providing an anvil (40) supporting said web as said web passes between said anvil and said press;
- cutting said web with said knife as said web passes between said press and said anvil.

J. The process according to Paragraph I, wherein said press is a rotary press rotating in a machine direction (MD) and said knife is mounted in a cross direction (CD) of said rotary press orthogonal to said machine direction; and wherein said anvil is a rotary anvil rotating counter to said rotary press.

K. The process according to Paragraph I or J, wherein said knife is mounted within 10 degrees of perpendicular to said press.

L. An apparatus (10) for cutting a web with the knife according to any of Paragraphs A to I comprising:
- a rotary press (30) having a machine direction (MD) and a cross direction (CD) orthogonal to said machine direction;
- a rotary anvil (40); and
- said knife, wherein said knife is positioned between said rotary press and said rotary anvil and mounted to said rotary press with said cutting edge oriented in said cross direction.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of cutting a web comprising steps of:
- providing a web;
- providing a knife mounted on a press, wherein said knife comprises:
- a cutting edge;
- a fixed edge; and
- a plurality of beam elements connecting said cutting edge to said fixed edge, each of said beam elements having a beam element extent oriented between 20 degrees and 80 degrees off of said cutting edge, each said beam element separated from adjacent beam elements by a reduced stiffness zone, each reduced stiffness zone having a reduced stiffness zone extent oriented from 20 degrees to 80 degrees off of said cutting edge, wherein each of said beam elements has a beam element width orthogonal to said beam element extent and a beam element length in line with said beam element extent, wherein each of said beam elements has a ratio of beam element length to beam element width from 2 to 40;

providing an anvil supporting said web as said web passes between said anvil and said press; and cutting said web with said knife as said web passes between said press and said anvil.

2. The process according to claim 1, wherein said press is a rotary press rotating in a machine direction and said knife is mounted in a cross direction of said rotary press orthogonal to said machine direction; and wherein said anvil is a rotary anvil rotating counter to said rotary press.

3. The process of claim 2, wherein said beam elements are nearer to said cutting edge than to said fixed edge.

4. The process of claim 3, wherein said reduced stiffness zones are slots.

5. The process of claim 2, wherein said knife is mounted approximately perpendicular to said rotary press.

6. The process of claim 1, wherein each of said reduced stiffness zones has a reduced stiffness zone width orthogonal to said reduced stiffness zone extent and a reduced stiffness zone length in line with said reduced stiffness zone extent, wherein each of said reduced stiffness zones has a ratio of reduced stiffness zone length to reduced stiffness zone width from 2 to 40.

7. An apparatus for cutting a web comprising:

a rotary press having a machine direction and a cross direction orthogonal to said machine direction;

a rotary anvil; and a knife comprising:

a cutting edge;

a fixed edge; and a plurality of beam elements connecting said cutting edge to said fixed edge, each of said beam elements having a beam element extent oriented from 20 degrees to 80 degrees off of said cutting edge, each said beam element separated from adjacent beam elements by a reduced stiffness zone, each reduced stiffness zone having a reduced stiffness zone extent oriented from 20 degrees to 80 degrees off of said cutting edge, wherein each of said beam elements has a beam element width orthogonal to said beam element extent and a beam element length in line with said beam element extent, wherein each of said beam elements has a ratio of beam element length to beam element width from 2 to 40, and wherein said knife is mounted to said rotary press with said cutting edge oriented in said cross direction.

8. The apparatus of claim 7, wherein said beam elements are nearer to said cutting edge than to said fixed edge.

9. The apparatus of claim 8, wherein said reduced stiffness zones are slots.

10. The apparatus of claim 8, wherein said knife is mounted approximately perpendicular to said rotary press.

11. The apparatus of claim 8, wherein each of said reduced stiffness zones has a reduced stiffness zone width orthogonal to said reduced stiffness zone extent and a reduced stiffness zone length in line with said reduced stiffness zone extent, wherein each of said reduced stiffness zones has a ratio of reduced stiffness zone length to reduced stiffness zone width from 2 to 40.

* * * * *